US010622003B2

(12) United States Patent
Cohen et al.

(10) Patent No.: US 10,622,003 B2
(45) Date of Patent: Apr. 14, 2020

(54) JOINT BEAMFORMING AND ECHO CANCELLATION FOR REDUCTION OF NOISE AND NON-LINEAR ECHO

(71) Applicant: INTEL IP CORPORATION, Santa Clara, CA (US)

(72) Inventors: Alejandro Cohen, Gan Yavne (IL); Shmuel Markovich-Golan, Ramat Hasharon (IL)

(73) Assignee: Intel IP Corporation, Santa Clara, CA (US)

( * ) Notice: Subject to any disclaimer, the term of this patent is extended or adjusted under 35 U.S.C. 154(b) by 33 days.

(21) Appl. No.: 16/033,370

(22) Filed: Jul. 12, 2018

(65) Prior Publication Data

US 2019/0043515 A1 Feb. 7, 2019

(51) Int. Cl.

| | |
|---|---|
| ***G10L 21/0208*** | (2013.01) |
| ***H04R 3/00*** | (2006.01) |
| ***H04R 3/02*** | (2006.01) |
| *G10L 21/0216* | (2013.01) |

(52) U.S. Cl.

CPC ..... *G10L 21/0208* (2013.01); *H04R 3/005* (2013.01); *H04R 3/02* (2013.01); *G10L 2021/02082* (2013.01); *G10L 2021/02166* (2013.01); *H04R 2430/20* (2013.01)

(58) Field of Classification Search

CPC ..... G10L 21/0208; H04R 3/005; H04R 3/02
USPC ..... 704/200, 226, 233; 381/92; 1/1; 455/91
See application file for complete search history.

(56) References Cited

U.S. PATENT DOCUMENTS

| | | | | |
|---|---|---|---|---|
| 10,349,173 | B2 * | 7/2019 | Risberg | H04R 3/007 |
| 2005/0095996 | A1 * | 5/2005 | Takano | H04B 7/0615 455/91 |
| 2010/0241428 | A1 * | 9/2010 | Yiu | H04R 3/005 704/233 |

(Continued)

OTHER PUBLICATIONS

Barnov, V. Bar Bracha, and S. Markovich-Golan, "QRD based MVDR beamforming for fast tracking of speech and noise dynamics," IEEE Workshop on Applications of Signal Processing to Audio and Acoustics, Oct. 2017, 5 pages.

(Continued)

*Primary Examiner* — Md S Elahee
(74) *Attorney, Agent, or Firm* — Finch & Maloney PLLC

(57) ABSTRACT

Techniques are provided for reduction of noise and nonlinear-echo. A methodology implementing the techniques according to an embodiment includes estimating transfer functions (TFs) of echo paths of audio signals received through a microphone array. The audio signals include speech signal, additive noise, and echo, the TF estimation based on the reference signal. The method also includes cancellation of linear components of the echo, based on the echo path TFs. The method further includes estimating an inverse square root of a covariance matrix of the additive noise, whitening the echo cancelled signals, and estimating a speech path RTF associated with the speech signal, based on the whitened echo cancelled signals. The method further includes performing beamforming on the whitened signals (such as weighted MVDR beamforming), based on the echo path TFs, the speech path RTF, and the estimated inverse square root additive noise covariance matrix.

21 Claims, 7 Drawing Sheets
(1 of 7 Drawing Sheet(s) Filed in Color)

(56) References Cited

U.S. PATENT DOCUMENTS

2014/0257802 A1* 9/2014 Asada ..... G10L 19/012
704/226

OTHER PUBLICATIONS

M. Zeller and W. Kellermann, "Fast and robust adaptation of DFT-domain Volterra filters in diagonal coordinates using iterated coefficient updates," IEEE Transactions on Signal Processing, vol. 58, No. 3, pp. 1589-1604, 2010.
S. Malik and G. Enzner, "State-space frequency-domain adaptive filtering for nonlinear acoustic echo cancellation," IEEE Transactions on audio, speech, and language processing, vol. 20, No. 7, pp. 2065-2079, 2012.
Hofmann, C. Huemmer, M. Guenther, and W. Kellermann, "Significance-aware filtering for nonlinear acoustic echo cancellation," EURASIP Journal on Advances in Signal Processing, 2016, 18 pages.
W. Kellermann, "Strategies for combining acoustic echo cancellation and adaptive beamforming microphone arrays," in Acoustics, Speech, and Signal Processing, 1997, 1997 IEEE International Conference on, 4 pages.
K.-D. Kammeyer, M. Kallinger, and A. Mertins, "New aspects of combining echo cancellers with beamformers," in Acoustics, Speech, and Signal Processing, 2005, IEEE International Conference on, 4 pages.
G. Reuven, S. Gannot, and I. Cohen, "Joint noise reduction and acoustic echo cancellation using the transfer-function generalized sidelobe ca celler," Speech communication, 2007, vol. 49, 4 pages.
S. Doclo, M. Moonen, and E. De Clippel, "Combined acoustic echo and noise reduction using GSVD-based optimal filtering," in Acoustics, Speech, and Signal Processing, 2000 IEEE International Conference on, 2000, 4 pages.
W. Herbordtt, S. Nakamura, and W. Kellermann, "Joint optimization of LCMV beamforming and acoustic echo cancellation for automatic speech recognition," in Acoustics, Speech, and Signal Processing, IEEE International Conference on, 2005, 4 pages.
M. Kallinger, J. Bitzer, and K.-D. Kammeyer, "Interpolation of MVDR beamformer coefficients for joint echo cancellation and noise reduction," 2001, 4 pages.
O. L. Frost, "An algorithm for linearly constrained adaptive array processing," Proceedings of the IEEE, vol. 60, No. 8, pp. 926-935, Aug. 1972.
S. Gannot, D. Burshtein, and E. Weinstein, "Signal enhancement using beamforming and nonstationarity with applications to speech," IEEE Transactions on Signal Processing, Aug. 2001, vol. 49, pp. 1614-1626.
B. Widrow and S. D. Stearns, "Adaptive signal processing," Summary of Chapter 2, Prentice-Hall, Inc., 1985, 10 pages.
J. A. Apolinário, "QRD-RLS adaptive filtering", Table 3.6 Pseudocode for the inverse QRD-RLS algorithm, Springer, 2009, 2 pages.
Simon Haykin, "Adaptive filter theory", Pearson Education India, Summary of Chapter 9 and Chapter 13, 2008, 25 pages.
S. Markovich, S. Gannot, and I. Cohen, "Multichannel eigenspace beam-forming in a reverberant noisy environment with multiple interfering speech signals," IEEE Transactions on Audio, Speech, and Language Processing, vol. 17, pp. 1071-1086, Aug. 2009.
Bertrand and M. Moonen, "Distributed node-specific LCMV beamforming in wireless sensor networks," IEEE Transactions on Signal Processing, 2012, vol. 60, 15 pages.
S. Markovich-Golan and S. Gannot, "Performance analysis of the covariance subtraction method for relative transfer function estimation and comparison to the covariance whitening method," in Acoustics, Speech and Signal Processing (ICASSP), 2015 IEEE International Conference on. IEEE, 2015, pp. 544-548.

* cited by examiner

JOINT BEAMFORMING AND ECHO CANCELLATION FOR REDUCTION OF NOISE AND NON-LINEAR ECHO

BACKGROUND

Noise and echo present difficulties for speech processing applications, including speech recognition, speech enhancement, and the like. This is particularly true in distant talker scenarios, where the desired speech component of a received signal is relatively weak, and the corresponding signal-to-noise ratio (SNR) and signal-to-echo ratio (SER) are low. Modern devices and platforms typically include a microphone array which enables some degree of spatial filtering, also referred to as beamforming, for enhancement of the desired speech component. Some existing systems perform beamforming followed by echo cancellation, but in these cases, the beamformer design is greatly complicated (e.g., computationally expensive) by the fact that the signal includes echo. Some other existing systems perform echo cancellation followed by beamforming, but this also increases complexity due to the need for multi-channel echo cancellation.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Features and advantages of embodiments of the claimed subject matter will become apparent as the following Detailed Description proceeds, and upon reference to the Drawings, wherein like numerals depict like parts.

Figure 1:
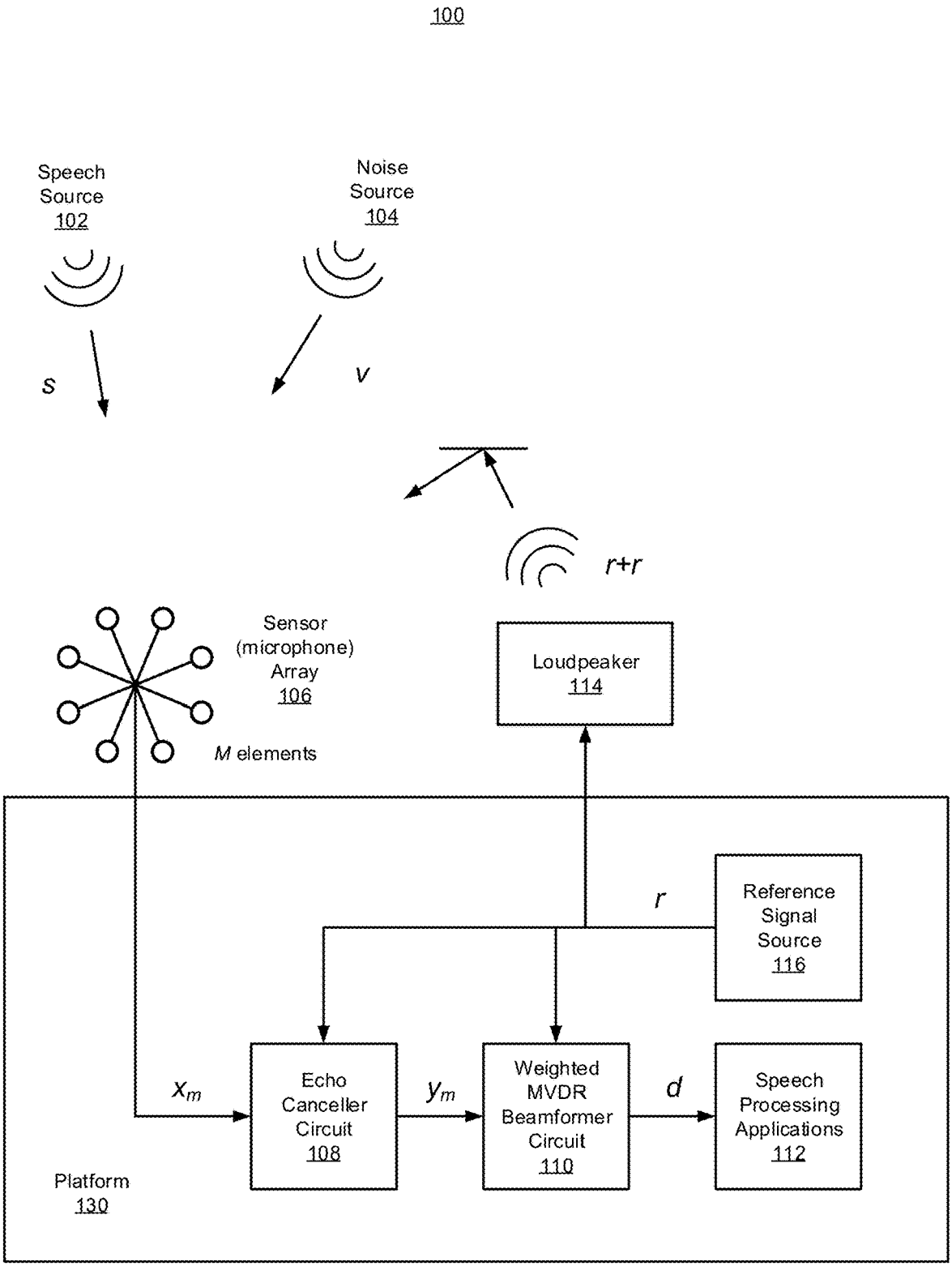
FIG. 1 is a top-level block diagram of a joint beamforming and echo cancellation system, configured in accordance with certain embodiments of the present disclosure.

Although the following Detailed Description will proceed with reference being made to illustrative embodiments, many alternatives, modifications, and variations thereof will be apparent in light of this disclosure.

DETAILED DESCRIPTION

Techniques are provided for joint beamforming and echo cancellation for reduction of noise and echo (including non-linear echo) in a multi-channel audio signal. Many devices and platforms which are configured to process audio signals, receive signals that include a speech component of interest but which are also corrupted by additive noise and echo. For example, during a phone conversation in speakerphone mode, a combination of echoes of the audio emitted through the phone's loudspeaker (referred to herein as a reference signal), along with background noise in the room, serve to corrupt the speech signal of interest generated by the user of the phone. Embodiments of the present disclosure provide techniques for increasing the signal-to-noise ratio (SNR) and the signal to echo ratio (SER) in a received signal to improve the quality of the speech component of that signal. This results in improved performance of speech processing applications that may subsequently operate on that signal and/or simply allows a cleaner speech signal to be transmitted on to a destination such as the remote party of a phone call. According to some such embodiments, an integrated combination, or coupling, of echo cancellation and beamforming is employed in a computationally efficient manner with reduced latency, as will be described in greater detail below. Both the echo cancellation and the beamforming employ a recursive least squares (RLS) based inverse QR decomposition which provides relatively fast convergence, according to some embodiments.

The disclosed techniques can be implemented, for example, in a computing system or a software product executable or otherwise controllable by such systems, although other embodiments will be apparent. The system or product is configured to perform joint beamforming and echo cancellation. In accordance with an embodiment, a methodology to implement these techniques estimates transfer functions (TFs) of echo paths of audio signals received through a microphone array, and cancels linear components of the reference signal echoes based on the echo path TFs. The audio signals include a desired speech signal, additive noise, and echo. The TF estimation is based on the reference signal. The methodology according to some such embodiments further includes the operations of estimating an inverse square root of a covariance matrix of the additive noise, whitening the echo cancelled signals, estimating a speech path relative transfer function (RTF) associated with the speech signal based on the whitened echo cancelled signals, and performing weighted Minimum Variance Distortionless Response beamforming on the whitened signals. The term "relative" is used to indicate that the transfer functions are normalized relative to a selected one of the microphones. The beamforming is based on the echo path TFs, the speech path RTF, and the estimated inverse square root additive noise covariance matrix.

As will be appreciated, the techniques described herein may provide increased SNR and SER with reduced computational complexity, compared to existing techniques which, among other things, fail to jointly perform echo cancellation and beamforming. The disclosed techniques can be implemented on a broad range of platforms including smartphones, smart-speakers, laptops, tablets, video conferencing systems, gaming systems, smart home control systems, and robotic systems. These techniques may further be implemented in hardware or software or a combination thereof.

FIG. 1 is a top-level block diagram 100 of a joint beamforming and echo cancellation system, configured in accordance with certain embodiments of the present disclosure. A device platform 130 is shown to include an array of M sensors or microphones 106, a loudspeaker 114, an echo canceller circuit 108, a weighted Minimum Variance Distortionless Response (MVDR) beamformer circuit 110, a reference signal source 116, and speech processing applications 112, such as, for example, a speech recognizer or voice communication application.

In some embodiments, the platform 130 may be a smartphone, a smart-speaker, a speech enabled entertainment system, a speech enabled home management system, or any system capable of broadcasting audio through a loudspeaker 114 while simultaneously receiving audio through an array of two or more microphones 106. For example, in the case of a smartphone operating in speakerphone mode, the loudspeaker 114 is configured to broadcast audio associated with the remote side of the conversation (which serves as the reference signal source 116), while the microphone array 106 is configured to receive audio containing speech from a user (i.e., the speech source 102) on the local side of the conversation (e.g., in the room with the smartphone). Alternatively, in the case of a smart-speaker or a speech enabled entertainment system, the loudspeaker 114 may broadcast the reading of an audio book as the reference signal source 116, for example, while the microphone array 106 is configured to receive speech commands from a user, such as, "skip to the next chapter," "speak louder," or "stop reading and play music," to give just a few examples. In either case, echoes of the reference signal serve as an undesirable interfering speech signal (along with background noise sources 104) which corrupts the received signal at the microphone array 106.

In the following discussions, the speech signal is designated s(t), the additive background noise is designated v(t), the reference signal is designated r(t), the received signal at each microphone element is designated $x_m(t)$, for m=1 to M, the output of the echo canceller is designated $y_m(t)$, for each of the M channels, and the output of the beamformer is designated d(t).

In some embodiments, particularly in smaller form factor devices such as a smartphone, the loudspeaker 114 is driven close to its compression point for increased efficiency at the expense of introducing non-linear distortions $\tilde{r}$ to the emitted signal. The disclosed techniques provide for the handling of these non-linear distortions, as will be explained in greater detail below.

The echo canceller circuit 108 is configured to track and cancel linear echo using a rapidly converging multichannel inverse QR decomposition (IQRD) method based on recursive least squares (RLS) minimization, as will be explained in greater detail below.

The weighted MVDR beamformer circuit 110 is configured to spatially filter the multichannel echo cancelled signal, also using a rapidly converging RLS based IQRD method. The spatial filter steers a beam in the direction of the speech source 102, reducing the noise source component of the received signal and also reducing any residual nonlinear echo components. Estimated acoustic echo paths generated by the echo canceller circuit 108 are employed by the beamformer which attenuates the direction of the echo, avoiding additional estimation of the echo field and reducing computational complexity. The beamformer circuit 110 is also configured to minimize a weighted sum of the noise and of the non-linear echo while maintaining the desired speech undistorted. This is accomplished by splitting the beamformer into a whitening stage, which spatially whitens the noise, followed by a multichannel filter which passes the desired speech undistorted while reducing the residual echo. Additionally, the relative transfer function (RTF) of the desired speech is estimated in the whitened domain, and as such does not require transformation back to the domain of the microphone signals, which further reduces computational complexity, as will be explained in greater detail below.

Figure 2:
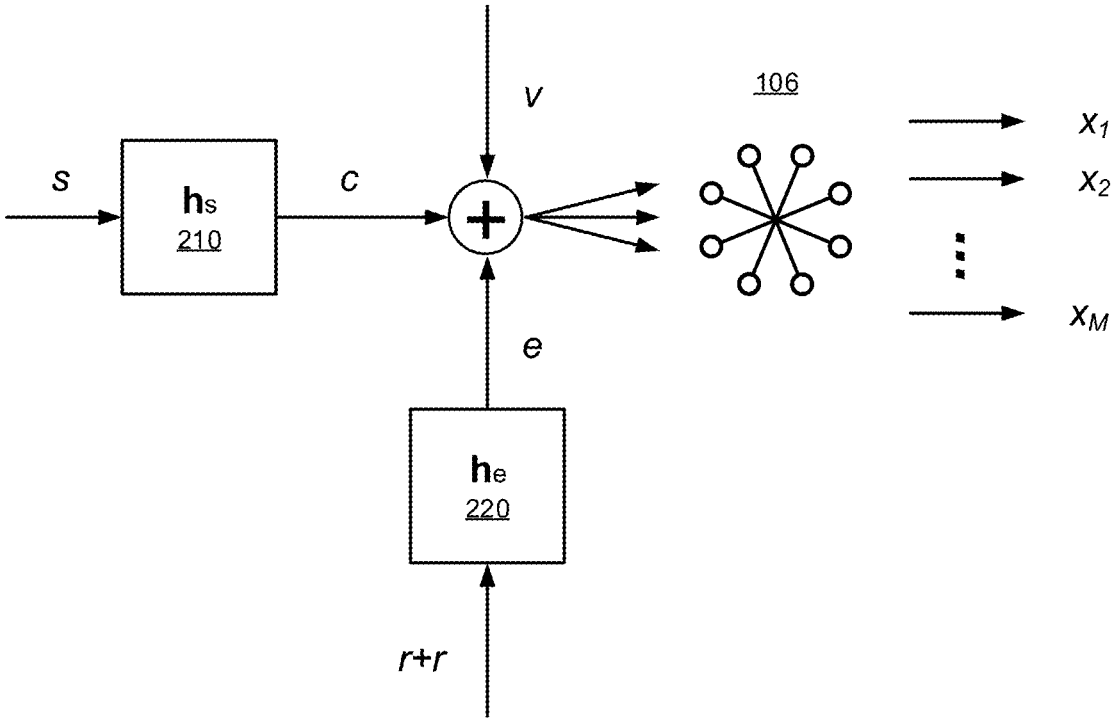
FIG. 2 illustrates signals associated with the joint beamforming and echo cancellation system, in accordance with certain embodiments of the present disclosure.

FIG. 2 illustrates signals associated with the joint beamforming and echo cancellation system, in accordance with certain embodiments of the present disclosure. The speech signal of the desired talker (e.g., from speech source 102) is designated as s(t) in the time domain, and is transformed by $h_{s,m}(t)$ 210 which are the acoustic impulse response of the environment through which s(t) propagates between the talker and each of the microphones. The transformed speech signal is designated as $c_m(t)$:

$$c_m(t) \triangleq h_{s,m}(t) * s(t)$$

where * denotes convolution. The non-linearly distorted reference signal is designated as $r(t)+\tilde{r}(t)$, and is transformed by $h_{e,m}(t)$ 220 which is the acoustic impulse response of the environment through which it propagates between the loudspeaker 114 and each of the microphones. The transformed non-linearly distorted reference signal is designated as $e_m(t)$:

$$e_m(t) \triangleq h_{e,m}(t) * (r(t)+\tilde{r}(t))$$

Under this model, the same transformation is applied to the reference signal and the non-linearly distorted reference signal. The additive background noise is designated as v(t), and the signals generated at each microphone $x_m(t)$ are a summation of these three components:

$$x_m(t) = c_m(t) + e_m(t) + v(t)$$

After transformation to the frequency domain, for example using a short time Fourier transform (STFT), the signals notation may be expressed as:

$$x(n,f) \triangleq c(n,f) + e(n,f) + v(n,f)$$

where $$c(n,f) \triangleq [c_1(n,f), \ldots, c_M(n,f)]^T = h_s(n,f)s(n,f)$$

$$e(n,f) \triangleq [e_1(n,f), \ldots, e_M(n,f)]^T = h_e(n,f)(r(n,f)+\tilde{r}(n,f))$$

are the speech and the echo component vectors, respectively, with $$h_s(n,f) \triangleq [h_{s,1}(n,f), \ldots, h_{s,M}(n,f)]^T$$

$$h_e(n,f) \triangleq [h_{e,1}(n,f), \ldots, h_{e,M}(n,f)]^T$$

defined to be the desired talker and echo acoustic TF vectors, respectively, and n and f denote the time-frame and frequency-bin indices.

Figure 3:
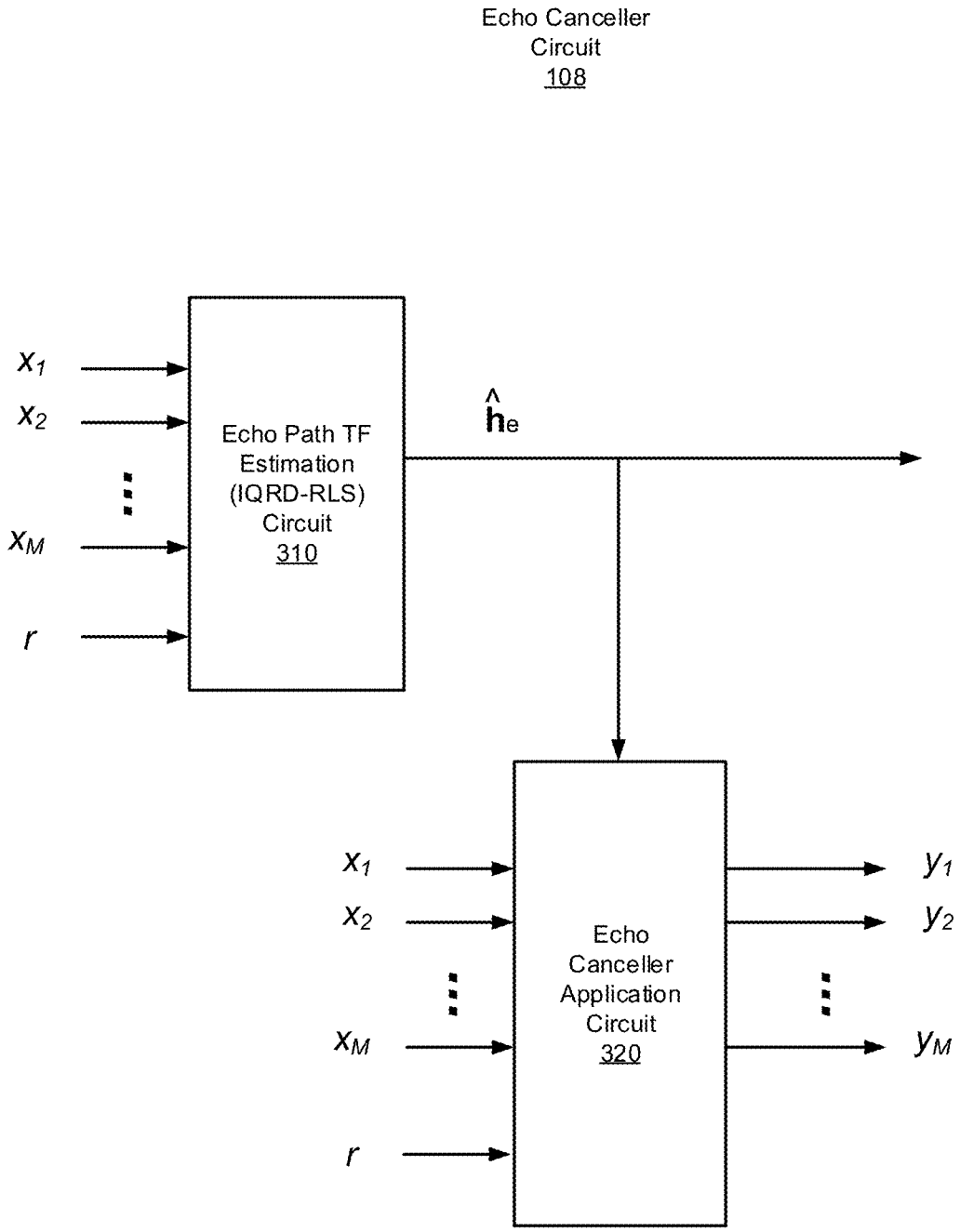
FIG. 3 is a more detailed block diagram of the echo canceller circuit, configured in accordance with certain embodiments of the present disclosure.

FIG. 3 is a more detailed block diagram of the echo canceller circuit 108, configured in accordance with certain embodiments of the present disclosure. The echo canceller circuit 108 is shown to include echo path transfer function (TF) estimation circuit 310 and echo canceller application circuit 320.

Echo path TF estimation circuit 310 is configured to estimate the TFs ($h_e$) of the echo paths associated with audio signals received through the microphone array. In some embodiments, circuit 310 is configured to estimate the echo path TFs based on an RLS-IQRD performed on the received audio signals $x_m$ and the known reference signal r (the system has access to the reference signal r that is used to drive the loudspeaker 114).

Echo canceller application circuit 320 is configured to cancel linear components of the echoes of the reference signal, based on the echo path TFs. This can be accomplished for example according to the following equation:

$$y(n,f) = x(n) - \hat{h}_e(n) r(n)$$

where $\hat{h}_e$ is the estimated TF of the echo paths and y(n,f) is the echo canceller multichannel output.

Figure 4:
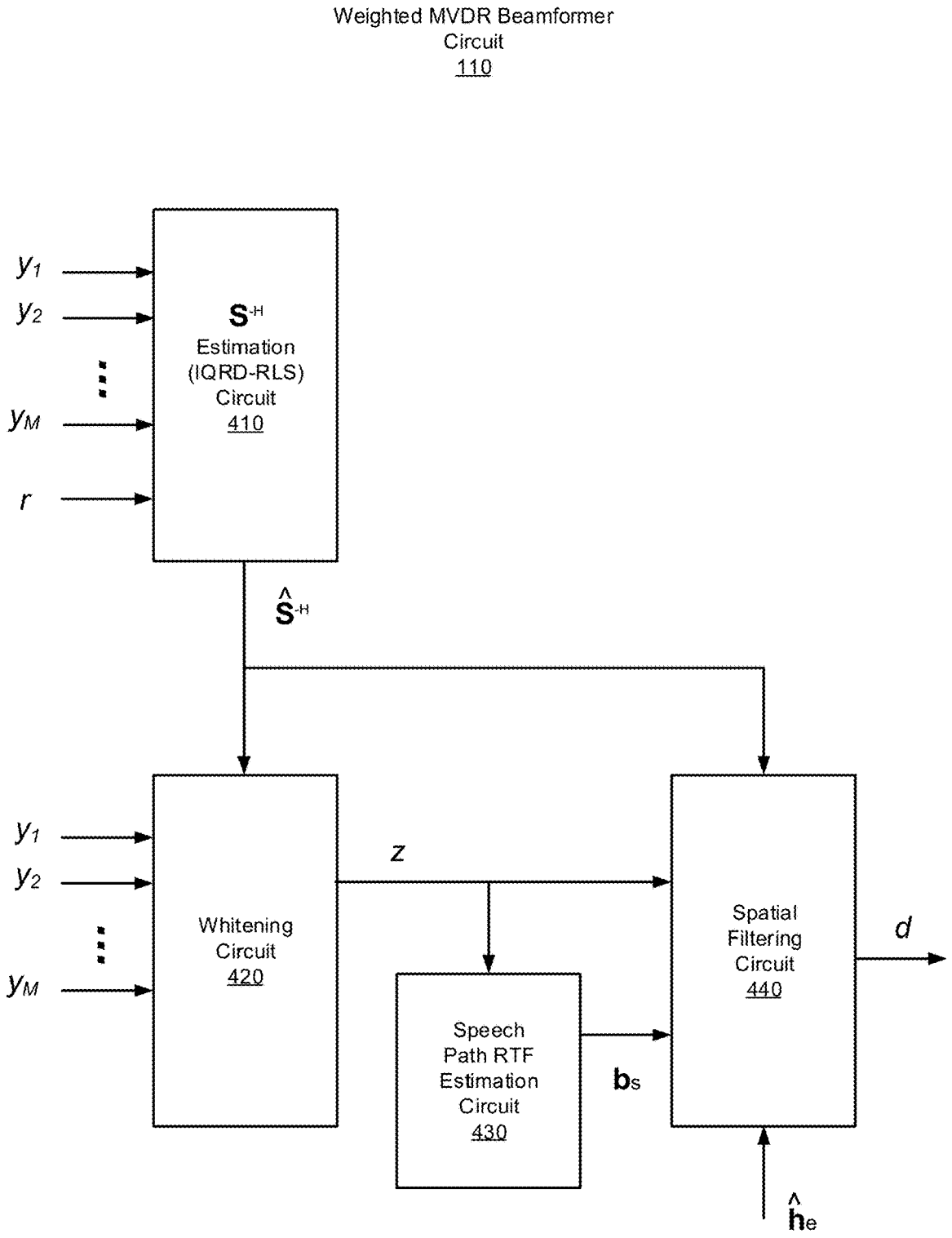
FIG. 4 is a more detailed block diagram of the weighted beamformer circuit, configured in accordance with certain embodiments of the present disclosure.

FIG. 4 is a more detailed block diagram of the weighted MVDR beamformer circuit 110, configured in accordance with certain embodiments of the present disclosure. The weighted MVDR beamformer circuit 110 is shown to include matrix square root estimation circuit 410, whitening circuit 420, speech path RTF estimation circuit 430, and spatial filtering circuit 440. The MVDR beamformer is configured to minimize the noise variance at the output while maintaining the desired speech signal without distortion through the use of a whitening stage, which spatially whitens the noise, followed by a multichannel filter which passes the desired talker undistorted and reduces the residual echo.

Matrix square root estimation circuit 410 is configured to estimate the square root of the inverse of the covariance matrix of the additive noise. This estimate is denoted as $S^{-H}$, where the exponent −H indicates inverse Hermitian matrix operation. In some embodiments, circuit 410 is configured to estimate $S^{-H}$ based on a an RLS-IQRD performed on the echo canceller output signals $y_m(n,f)$ and the known reference signal r.

Whitening circuit 420 is configured to whiten the echo cancelled signals. This can be accomplished for example according to the following equation:

$$z(n)=S^{-H}(n)y(n)$$

where z(n) is the whitened echo cancelled signal.

Speech path RTF estimation circuit 430 is configured to estimate the speech path RTF, $b_s(n)$, associated with the speech signal, based on the whitened echo cancelled signals z(n). In some embodiments, the speech path RTF is estimated during time periods when the speech signal is present and the echo signal is absent. The speech path RTF $b_s(n)$ is estimated as follows:

First, an estimate $\hat{\Phi}_z(n)$ of the covariance matrix of z(n) is calculated and updated as:

$$\hat{\Phi}_z(n)=\lambda_z\hat{\Phi}_z(n-1)+(1-\lambda_z)z(n)z^H(n)$$

which is initialized as:

$$\hat{\Phi}_z(0)=z(0)z^H(0)$$

and where $\lambda_z$ is a memory decay factor for the iterations.

Then $b_s(n)$ is calculated as:

$$j_m \triangleq [0_{1\times(m-1)},\ 1,\ 0_{1\times(M-m)}]^T$$

$$\theta(n) \triangleq (\hat{\Phi}_z(n)-I)\frac{(\hat{\Phi}_z(n)-I)j_1}{\|(\hat{\Phi}_z(n)-I)j_1\|}$$

$$\hat{g}(n)=\frac{1}{M}\sum_{m=1}^{M}\frac{1}{\theta_m^*(n)}(\hat{\Phi}_z(n)-I)j_m$$

$$b_s(n)=(S^{-H}(n))_{1,1}g(n)/g_1(n).$$

where $j_m$ is a selection vector that is used for extracting the m-th column of an M×M matrix, I is the identity matrix, and $\hat{g}(n)$ is an estimate of the principle eigenvector of $\hat{\Phi}_z(n)$. The calculation complexity of approximating the principle eigenvector using this technique is $O(M^2)$, which is significantly lower than the complexity of performing an eigenvalue decomposition which is $O(M^3)$.

Spatial filtering circuit 440 is configured to perform weighted MVDR beamforming on the whitened echo cancelled signals, based on the echo path TFs $\hat{h}_e$ (n), the speech path RTF $b_s(n)$, and the estimated inverse square root covariance matrix of the additive noise $S^{-H}$. The spatial filtering will also further reduce the non-linear distortion components of the echo.

The beamforming weights, q(n), are calculated according to the following: First, a whitened echo TF, $b_e$ (n), is calculated as:

$$b_e(n)\triangleq S^{-H}(n)h_e(n)$$

The time varying spectrum of the reference signal is then estimated and updated as:

$$\hat{\phi}_r(n)=\lambda_r\hat{\phi}_r(n-1)+(1-\lambda_r)|r(n)|^2$$

which is initialized as:

$$\hat{\phi}_r(0)=|r(0)|^2$$

and where $\lambda_r$ is a memory decay factor for the iterations.

The spectrum of the non-linearly distorted reference signal is modeled as a frequency dependent scaled version of the spectrum of the reference signal:

$$\hat{\phi}_{\tilde{r}}(n)=\hat{\phi}_r(n)\eta_r$$

where $\eta_r$ is pre-calibrated time-invariant frequency scaling factor. Alternatively, a spectrum of the non-linear echo component can be approximated using a non-linear model of the loudspeaker and the spectrum of the reference signal.

Next, define ρ(n) and α(n) as:

$$\rho(n)\triangleq b_e^H(n)b_s(n)$$

$$\alpha(n)\triangleq 1/(\mu\phi_{\tilde{r}}(n))+\|b_e(n)\|^2$$

where μ is a selected weight factor. And then the beamforming weights q(n) are calculated as:

$$q(n)\triangleq\frac{b_s(n)-(\rho(n)/\alpha(n))b_e(n)}{\|b_s(n)\|^2-|\rho(n)|^2/\alpha(n)}.$$

The output of the beamforming, d(n), is obtained by applying the beamforming weights to the whitened echo cancelled signals z (n) as:

$$d(n)\triangleq q^H(n)z(n)$$

The output signal is transformed back to the time domain, for example by an inverse Fourier transform, and denoted d(t).

In some embodiments, the following sample parameters may be used:

$$\mu=1,\lambda_z=0.99,\text{ and }\eta_r=0.0631.$$

Figure 5:
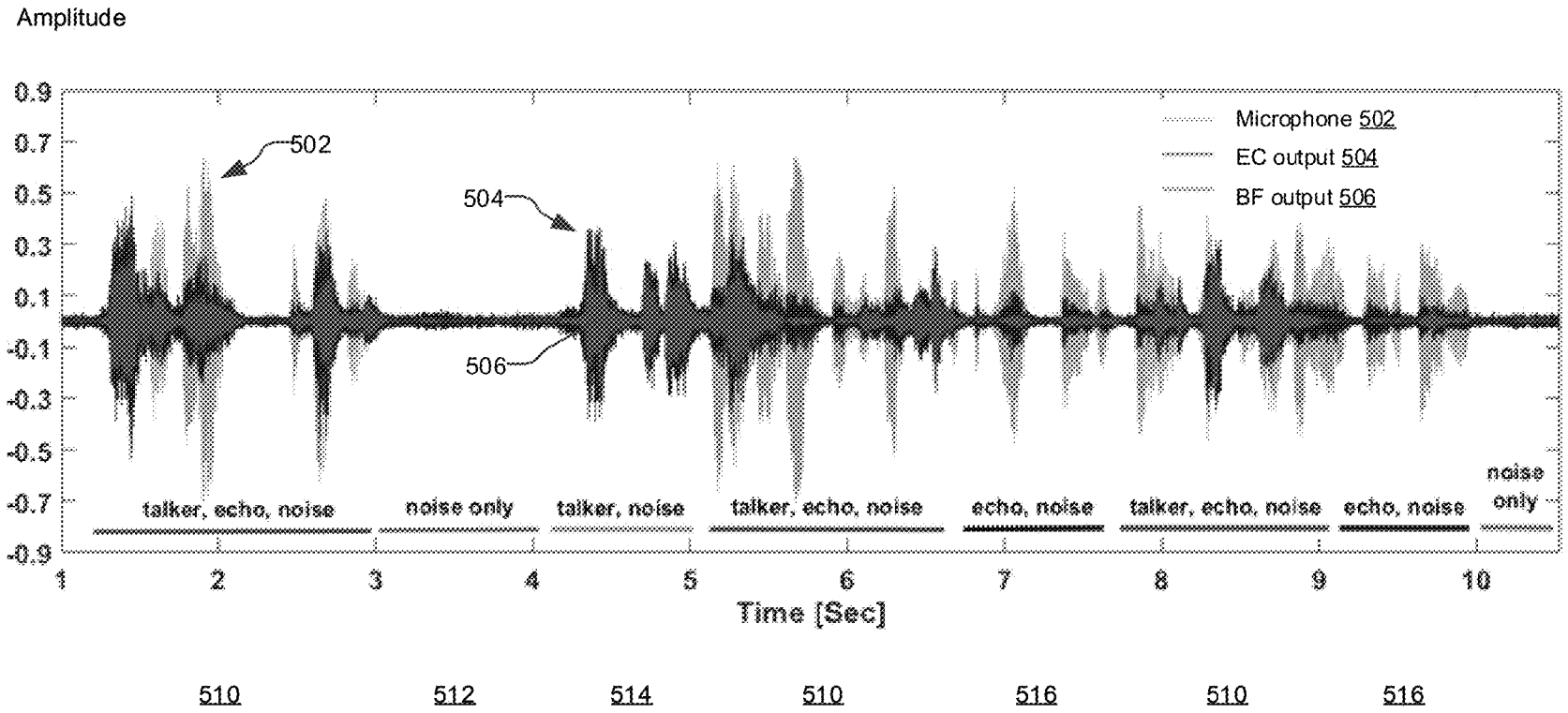
FIG. 5 illustrates results of the processing of received signals, in accordance with certain embodiments of the present disclosure.

FIG. 5 illustrates results of the processing of received signals, in a graphical format 500, in accordance with certain embodiments of the present disclosure. Plot 502 shows the received input signal $x_1$ at one microphone of the array. Plot 504 shows the output y of the echo canceller. Plot 506 shows the output d of the beamformer. All plots depict signal amplitude versus time. During the time intervals labeled 510, the input signal includes speech (talker), echo, and noise. During the time interval labeled 512, the input signal includes only noise. During the time interval labeled 514, the input signal includes speech and noise. During the time intervals labeled 516, the input signal includes echo and noise. As can be seen, the output of the echo canceller 504 shows a reduction in echo during the time intervals where echo is present, and shows little affect during the time intervals without echo. It can also be seen, that the output of the beamformer 506 shows additional improvement through reduction of noise along with some further reduction in echo.

Methodology

Figure 6:
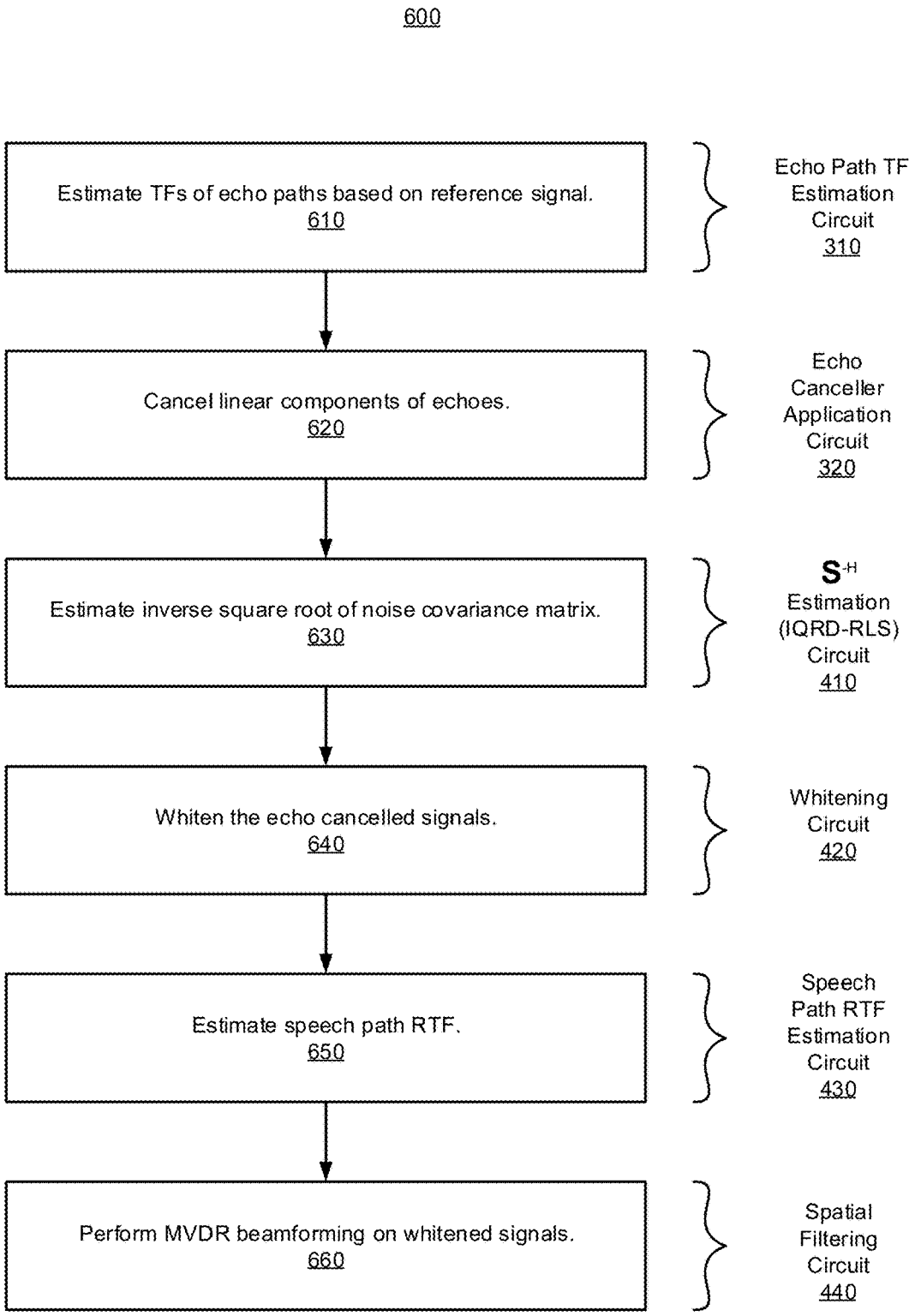
FIG. 6 is a flowchart illustrating a methodology for joint beamforming and echo cancellation, in accordance with certain embodiments of the present disclosure.

FIG. 6 is a flowchart illustrating an example method 600 for joint beamforming and echo cancellation for reduction of noise and non-linear echo, in accordance with certain embodiments of the present disclosure. As can be seen, the example method includes a number of phases and sub-processes, the sequence of which may vary from one embodiment to another. However, when considered in the aggregate, these phases and sub-processes form a process for joint beamforming and echo cancellation, in accordance with certain of the embodiments disclosed herein. These embodiments can be implemented, for example, using the system architecture illustrated in FIGS. 1, 3, and 4, as described above. However other system architectures can be used in other embodiments, as will be apparent in light of this disclosure. To this end, the correlation of the various functions shown in FIG. 6 to the specific components illustrated in the other figures is not intended to imply any structural and/or use limitations. Rather, other embodiments may include, for example, varying degrees of integration wherein multiple functionalities are effectively performed by one system. For example, in an alternative embodiment a single module having decoupled sub-modules can be used to perform all of the functions of method 600. Thus, other embodiments may have fewer or more modules and/or sub-modules depending on the granularity of implementation. In still other embodiments, the methodology depicted can be implemented as a computer program product including one or more non-transitory machine-readable mediums that when executed by one or more processors cause the methodology to be carried out. Numerous variations and alternative configurations will be apparent in light of this disclosure.

As illustrated in FIG. 6, in an embodiment, method 600 for joint beamforming and echo cancellation commences by estimating, at operation 610, transfer functions (TFs) of echo paths associated with audio signals received through an array of microphones. The audio signals include a combination of a speech signal, additive noise, and echo. The estimation of echo path TFs is based on the reference signal. In some embodiments, the estimation of the echo path TFs employs a Recursive Least Squares (RLS)-Inverse QR Decomposition (IQRD) operation.

Next, at operation 620, linear components of the echo are cancelled, based on the echo path TFs.

At operation 630, the square root of the inverse of the covariance matrix of the additive noise is estimated. In some embodiments, the estimation of the square root of the inverse of the noise covariance matrix also employs an RLS-IQRD operation.

At operation 640, the echo cancelled signals are whitened. At operation 650, a speech path RTF, associated with the speech signal, is estimated. The estimation is based on the whitened echo cancelled signals.

At operation 660, weighted Minimum Variance Distortionless Response (MVDR) beamforming is performed on the whitened echo cancelled signals. The beamforming is based on the echo path TFs, the speech path RTF, and the estimated square root of the inverse of the covariance matrix of the additive noise.

Of course, in some embodiments, additional operations may be performed, as previously described in connection with the system. For example, the reference signal may be generated to include non-linear distortion components, and the MVDR beamforming can use these components to further reduce the non-linear distortion components of the echo. In some embodiments, the estimating of the speech path RTF is performed during time periods associated with the presence of the speech signal and the absence of the echo signal.

Example System

Figure 7:
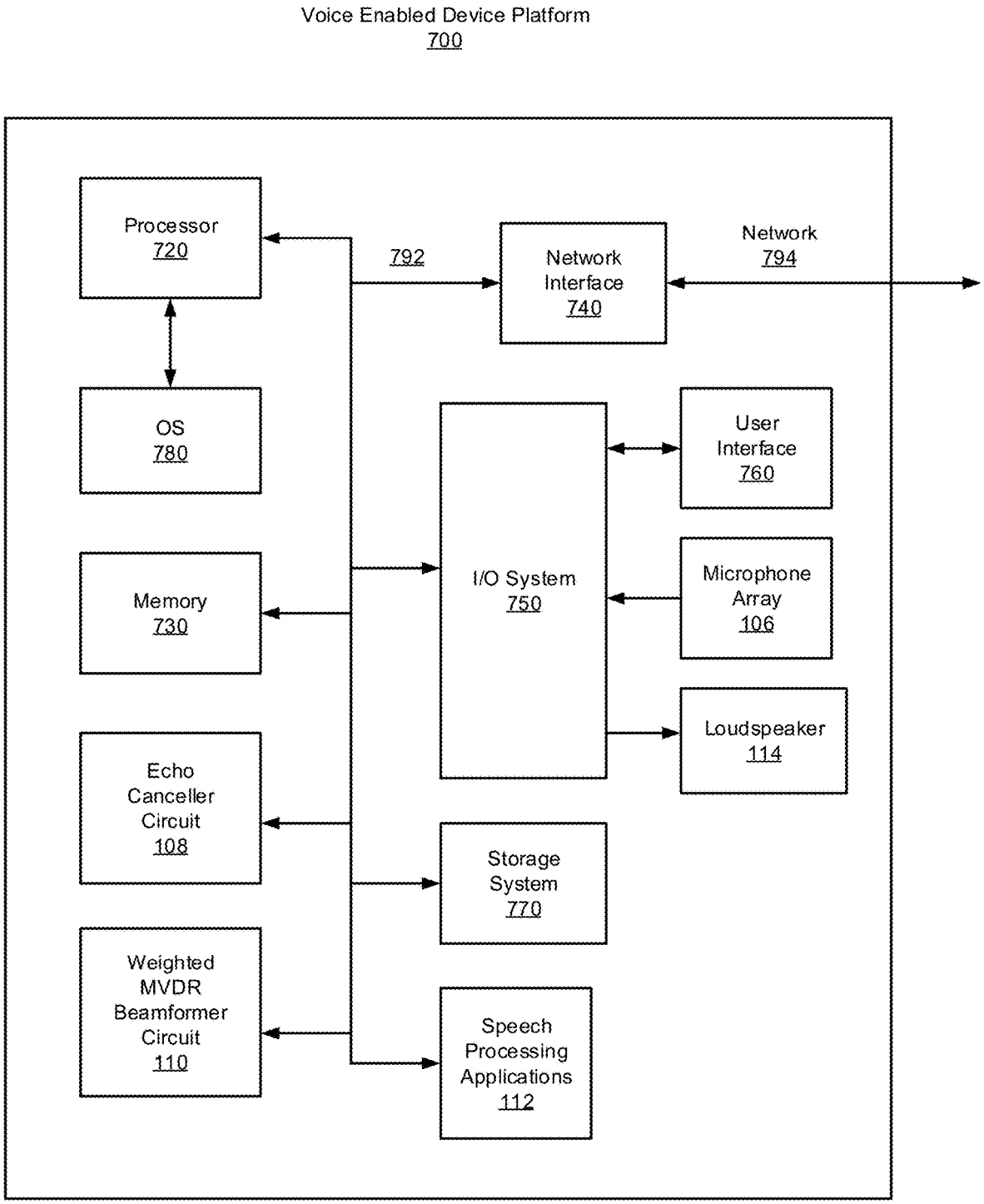
FIG. 7 is a block diagram schematically illustrating a voice-enabled device platform configured to perform joint beamforming and echo cancellation, in accordance with certain embodiments of the present disclosure.

FIG. 7 illustrates an example voice-enabled device platform 700, configured in accordance with certain embodiments of the present disclosure, to perform joint beamforming and echo cancellation for reduction of noise and non-linear echo. In some embodiments, platform 700 may be hosted on, or otherwise be incorporated into a personal computer, workstation, server system, smart home management system, laptop computer, ultra-laptop computer, tablet, touchpad, portable computer, handheld computer, palmtop computer, personal digital assistant (PDA), cellular telephone, combination cellular telephone and PDA, smart device (for example, smartphone, smart-speaker, or smart-tablet), mobile internet device (MID), messaging device, data communication device, wearable device, embedded system, and so forth. Any combination of different devices may be used in certain embodiments.

In some embodiments, platform 700 may comprise any combination of a processor 720, a memory 730, echo canceller circuit 108, weighted MVDR beamformer circuit 110, speech processing applications 112, a network interface 740, an input/output (I/O) system 750, a user interface 760, a microphone array 106, a loudspeaker 114, and a storage system 770. As can be further seen, a bus and/or interconnect 792 is also provided to allow for communication between the various components listed above and/or other components not shown. Platform 700 can be coupled to a network 794 through network interface 740 to allow for communications with other computing devices, platforms, devices to be controlled, or other resources. Other componentry and functionality not reflected in the block diagram of FIG. 7 will be apparent in light of this disclosure, and it will be appreciated that other embodiments are not limited to any particular hardware configuration.

Processor 720 can be any suitable processor, and may include one or more coprocessors or controllers, such as an audio processor, a graphics processing unit, or hardware accelerator, to assist in control and processing operations associated with platform 700. In some embodiments, the processor 720 may be implemented as any number of processor cores. The processor (or processor cores) may be any type of processor, such as, for example, a microprocessor, an embedded processor, a digital signal processor (DSP), a graphics processor (GPU), a network processor, a field programmable gate array or other device configured to execute code. The processors may be multithreaded cores in that they may include more than one hardware thread context (or "logical processor") per core. Processor 720 may be implemented as a complex instruction set computer (CISC) or a reduced instruction set computer (RISC) processor. In some embodiments, processor 720 may be configured as an x86 instruction set compatible processor.

Memory 730 can be implemented using any suitable type of digital storage including, for example, flash memory and/or random-access memory (RAM). In some embodiments, the memory 730 may include various layers of memory hierarchy and/or memory caches as are known to those of skill in the art. Memory 730 may be implemented as a volatile memory device such as, but not limited to, a RAM, dynamic RAM (DRAM), or static RAM (SRAM) device. Storage system 770 may be implemented as a non-volatile storage device such as, but not limited to, one or more of a hard disk drive (HDD), a solid-state drive (SSD), a universal serial bus (USB) drive, an optical disk drive, tape drive, an internal storage device, an attached storage device, flash memory, battery backed-up synchronous DRAM (SDRAM), and/or a network accessible storage device. In some embodiments, storage 770 may comprise technology to increase the storage performance enhanced protection for valuable digital media when multiple hard drives are included.

Processor 720 may be configured to execute an Operating System (OS) 780 which may comprise any suitable operating system, such as Google Android (Google Inc., Mountain View, Calif.), Microsoft Windows (Microsoft Corp., Redmond, Wash.), Apple OS X (Apple Inc., Cupertino, Calif.), Linux, or a real-time operating system (RTOS). As will be appreciated in light of this disclosure, the techniques provided herein can be implemented without regard to the particular operating system provided in conjunction with platform 700, and therefore may also be implemented using any suitable existing or subsequently-developed platform.

Network interface circuit 740 can be any appropriate network chip or chipset which allows for wired and/or wireless connection between other components of device platform 700 and/or network 794, thereby enabling platform 700 to communicate with other local and/or remote computing systems, servers, cloud-based servers, and/or other resources. Wired communication may conform to existing (or yet to be developed) standards, such as, for example, Ethernet. Wireless communication may conform to existing (or yet to be developed) standards, such as, for example, cellular communications including LTE (Long Term Evolution), Wireless Fidelity (Wi-Fi), Bluetooth, and/or Near Field Communication (NFC). Exemplary wireless networks include, but are not limited to, wireless local area networks, wireless personal area networks, wireless metropolitan area networks, cellular networks, and satellite networks.

I/O system 750 may be configured to interface between various I/O devices and other components of device platform 700. I/O devices may include, but not be limited to, user interface 760, microphone array 106, and loudspeaker 114. User interface 760 may include devices (not shown) such as a display element, touchpad, keyboard, and mouse, etc. I/O system 750 may include a graphics subsystem configured to perform processing of images for rendering on the display element. Graphics subsystem may be a graphics processing unit or a visual processing unit (VPU), for example. An analog or digital interface may be used to communicatively couple graphics subsystem and the display element. For example, the interface may be any of a high definition multimedia interface (HDMI), DisplayPort, wireless HDMI, and/or any other suitable interface using wireless high definition compliant techniques. In some embodiments, the graphics subsystem could be integrated into processor 720 or any chipset of platform 700.

It will be appreciated that in some embodiments, the various components of platform 700 may be combined or integrated in a system-on-a-chip (SoC) architecture. In some embodiments, the components may be hardware components, firmware components, software components or any suitable combination of hardware, firmware or software.

Echo canceller circuit 108 and beamformer circuit 110 are configured to enhance the quality of a received speech signal through joint beamforming echo cancellation, as described previously. The enhance speech signal may be provided to speech processing applications 112 for improved performance. Echo canceller circuit 108 and beamformer circuit 110 may include any or all of the circuits/components illustrated in FIGS. 1, 3 and 4, as described above. These components can be implemented or otherwise used in conjunction with a variety of suitable software and/or hardware that is coupled to or that otherwise forms a part of platform 700. These components can additionally or alternatively be implemented or otherwise used in conjunction with user I/O devices that are capable of providing information to, and receiving information and commands from, a user.

In some embodiments, these circuits may be installed local to platform 700, as shown in the example embodiment of FIG. 7. Alternatively, platform 700 can be implemented in a client-server arrangement wherein at least some functionality associated with these circuits is provided to platform 700 using an applet, such as a JavaScript applet, or other downloadable module or set of sub-modules. Such remotely accessible modules or sub-modules can be provisioned in real-time, in response to a request from a client computing system for access to a given server having resources that are of interest to the user of the client computing system. In such embodiments, the server can be local to network 794 or remotely coupled to network 794 by one or more other networks and/or communication channels. In some cases, access to resources on a given network or computing system may require credentials such as usernames, passwords, and/or compliance with any other suitable security mechanism.

In various embodiments, platform 700 may be implemented as a wireless system, a wired system, or a combination of both. When implemented as a wireless system, platform 700 may include components and interfaces suitable for communicating over a wireless shared media, such as one or more antennae, transmitters, receivers, transceivers, amplifiers, filters, control logic, and so forth. An example of wireless shared media may include portions of a wireless spectrum, such as the radio frequency spectrum and so forth. When implemented as a wired system, platform 700 may include components and interfaces suitable for communicating over wired communications media, such as input/output adapters, physical connectors to connect the input/output adaptor with a corresponding wired communications medium, a network interface card (NIC), disc controller, video controller, audio controller, and so forth. Examples of wired communications media may include a wire, cable metal leads, printed circuit board (PCB), backplane, switch fabric, semiconductor material, twisted pair wire, coaxial cable, fiber optics, and so forth.

Various embodiments may be implemented using hardware elements, software elements, or a combination of both. Examples of hardware elements may include processors, microprocessors, circuits, circuit elements (for example, transistors, resistors, capacitors, inductors, and so forth), integrated circuits, ASICs, programmable logic devices, digital signal processors, FPGAs, logic gates, registers, semiconductor devices, chips, microchips, chipsets, and so forth. Examples of software may include software components, programs, applications, computer programs, application programs, system programs, machine programs, operating system software, middleware, firmware, software modules, routines, subroutines, functions, methods, procedures, software interfaces, application program interfaces, instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power level, heat tolerances, processing cycle budget, input data rates, output data rates, memory resources, data bus speeds, and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still cooperate or interact with each other.

The various embodiments disclosed herein can be implemented in various forms of hardware, software, firmware, and/or special purpose processors. For example, in one embodiment at least one non-transitory computer readable storage medium has instructions encoded thereon that, when executed by one or more processors, cause one or more of the beamforming and echo cancellation methodologies disclosed herein to be implemented. The instructions can be encoded using a suitable programming language, such as C, C++, object oriented C, Java, JavaScript, Visual Basic .NET, Beginner's All-Purpose Symbolic Instruction Code (BASIC), or alternatively, using custom or proprietary instruction sets. The instructions can be provided in the form of one or more computer software applications and/or applets that are tangibly embodied on a memory device, and that can be executed by a computer having any suitable architecture. In one embodiment, the system can be hosted on a given website and implemented, for example, using JavaScript or another suitable browser-based technology. For instance, in certain embodiments, the system may leverage processing resources provided by a remote computer system accessible via network 794. In other embodiments, the functionalities disclosed herein can be incorporated into other voice-enabled devices and speech-based software applications, such as, for example, automobile control/navigation, smart-home management, entertainment, personal assistant, and robotic applications. The computer software applications disclosed herein may include any number of different modules, submodules, or other components of distinct functionality, and can provide information to, or receive information from, still other components. These modules can be used, for example, to communicate with input and/or output devices such as a display screen, a touch sensitive surface, a printer, and/or any other suitable device. Other componentry and functionality not reflected in the illustrations will be apparent in light of this disclosure, and it will be appreciated that other embodiments are not limited to any particular hardware or software configuration. Thus, in other embodiments platform 700 may comprise additional, fewer, or alternative subcomponents as compared to those included in the example embodiment of FIG. 7.

The aforementioned non-transitory computer readable medium may be any suitable medium for storing digital information, such as a hard drive, a server, a flash memory, and/or random-access memory (RAM), or a combination of memories. In alternative embodiments, the components and/or modules disclosed herein can be implemented with hardware, including gate level logic such as a field-programmable gate array (FPGA), or alternatively, a purpose-built semiconductor such as an application-specific integrated circuit (ASIC). Still other embodiments may be implemented with a microcontroller having a number of input/output ports for receiving and outputting data, and a number of embedded routines for carrying out the various functionalities disclosed herein. It will be apparent that any suitable combination of hardware, software, and firmware can be used, and that other embodiments are not limited to any particular system architecture.

Some embodiments may be implemented, for example, using a machine readable medium or article which may store an instruction or a set of instructions that, if executed by a machine, may cause the machine to perform a method, process, and/or operations in accordance with the embodiments. Such a machine may include, for example, any suitable processing platform, computing platform, computing device, processing device, computing system, processing system, computer, process, or the like, and may be implemented using any suitable combination of hardware and/or software. The machine readable medium or article may include, for example, any suitable type of memory unit, memory device, memory article, memory medium, storage device, storage article, storage medium, and/or storage unit, such as memory, removable or non-removable media, erasable or non-erasable media, writeable or rewriteable media, digital or analog media, hard disk, floppy disk, compact disk read only memory (CD-ROM), compact disk recordable (CD-R) memory, compact disk rewriteable (CD-RW) memory, optical disk, magnetic media, magneto-optical media, removable memory cards or disks, various types of digital versatile disk (DVD), a tape, a cassette, or the like. The instructions may include any suitable type of code, such as source code, compiled code, interpreted code, executable code, static code, dynamic code, encrypted code, and the like, implemented using any suitable high level, low level, object oriented, visual, compiled, and/or interpreted programming language.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical entities within the registers, memory units, or other such information storage transmission or displays of the computer system. The embodiments are not limited in this context.

The terms "circuit" or "circuitry," as used in any embodiment herein, are functional and may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., nonvolatile) in memory devices. The circuitry may, collectively or individually, be embodied as circuitry that forms part of a larger system, for example, an integrated circuit (IC), an application-specific integrated circuit (ASIC), a system-on-a-chip (SoC), desktop computers, laptop computers, tablet computers, servers, smartphones, etc. Other embodiments may be implemented as software executed by a programmable control device. In such cases, the terms "circuit" or "circuitry" are intended to include a combination of software and hardware such as a programmable control device or a processor capable of executing the software. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be understood by an ordinarily-skilled artisan, however, that the embodiments may be practiced without these specific details. In other instances, well known operations, components and circuits have not been described in detail so as not to obscure the embodiments. It can be appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

Example 1 is a processor-implemented method for reducing noise and echo in an audio signal, the method comprising: estimating, by a processor-based system, a transfer function (TF) of an echo path associated with a received audio signal, the audio signal including a combination of a speech signal, additive noise, and an echo signal, the estimation based on the reference signal; performing, by the processor-based system, cancellation of one or more linear components of the echo signal, based on the echo path TF, to provide an echo cancelled signal; estimating, by the processor-based system, a square root of an inverse of a covariance matrix of the additive noise; whitening, by the processor-based system, the echo cancelled signal; estimating, by the processor-based system, a speech path RTF associated with the speech signal, based on the whitened echo cancelled signal; and performing, by the processor-based system, beamforming on the whitened echo cancelled signal, based on the echo path TF, the speech path RTF, and the estimated square root of the inverse of the covariance matrix of the additive noise.

Example 2 includes the subject matter of Example 1, wherein the estimation of the echo path TF employs a Recursive Least Squares (RLS)-Inverse QR Decomposition (IQRD).

Example 3 includes the subject matter of Examples 1 or 2, wherein the estimation of the square root of the inverse of the covariance matrix of the additive noise employs an RLS-IQRD.

Example 4 includes the subject matter of any of Examples 1-3, wherein the beamforming is weighted Minimum Variance Distortionless Response (MVDR) beamforming, the method further comprising generating the echo signal to include non-linear distortion components, the MVDR beamforming further to reduce the non-linear distortion components of the echo signal.

Example 5 includes the subject matter of any of Examples 1-4, wherein the estimating of the speech path RTF is performed during time periods associated with the presence of the speech signal and the absence of the echo signal.

Example 6 includes the subject matter of any of Examples 1-5, wherein the processor-based system is a smartphone and the echo signal is generated by a loudspeaker of the smartphone during a voice call in speakerphone mode.

Example 7 includes the subject matter of any of Examples 1-6, wherein the processor-based system is a smart-speaker system and the echo signal is generated by playing selected audio content.

Example 8 is a system for reducing noise and echo in an audio signal, the system comprising: an echo path transfer function (TF) estimation circuit to estimate the TF of an echo path associated with a received audio signal, the audio signal including a combination of a speech signal, additive noise, and an echo signal, the estimation based on the reference signal; an echo canceller application circuit to cancel one or more linear components of the echo signal, based on the echo path TF, to provide an echo cancelled signal; a matrix square root estimation circuit to estimate a square root of an inverse of a covariance matrix of the additive noise; a whitening circuit to whiten the echo cancelled signal; a speech path RTF estimation circuit to estimate a speech path RTF associated with the speech signal, based on the whitened echo cancelled signal; and a spatial filtering circuit to perform beamforming on the whitened echo cancelled signal, based on the echo path TF, the speech path RTF, and the estimated square root of the inverse of the covariance matrix of the additive noise.

Example 9 includes the subject matter of Example 8, wherein the echo path TF estimation circuit is further to estimate the echo path TF based on a Recursive Least Squares (RLS)-Inverse QR Decomposition (IQRD).

Example 10 includes the subject matter of Examples 8 or 9, wherein the matrix square root estimation circuit is further to estimate the square root of the inverse of the covariance matrix of the additive noise based on an RLS-IQRD.

Example 11 includes the subject matter of any of Examples 8-10, wherein the beamforming is weighted Minimum Variance Distortionless Response (MVDR) beamforming, the system further comprising a loudspeaker to generate the echo signal to include non-linear distortion components, the spatial filtering circuit further to reduce the non-linear distortion components of the echo signal.

Example 12 includes the subject matter of any of Examples 8-11, wherein the estimating of the speech path RTF is performed during time periods associated with the presence of the speech signal and the absence of the echo signal.

Example 13 includes the subject matter of any of Examples 8-12, wherein the system is a smartphone and the echo signal is generated by a loudspeaker of the smartphone during a voice call in speakerphone mode.

Example 14 includes the subject matter of any of Examples 8-13, wherein the system is a smart-speaker system and the echo signal is generated by playing selected audio content.

Example 15 is at least one non-transitory computer readable storage medium having instructions encoded thereon that, when executed by one or more processors, cause a process to be carried out for reducing noise and echo in an audio signal, the process comprising: estimating a transfer function (TF) of an echo path associated with a received audio signal, the audio signal including a combination of a speech signal, additive noise, and an echo signal, the estimation based on the reference signal; performing cancellation of one or more linear components of the echo signal, based on the echo path TF, to provide an echo cancelled signal; estimating a square root of an inverse of a covariance matrix of the additive noise; whitening the echo cancelled signal; estimating a speech path RTF associated with the speech signal, based on the whitened echo cancelled signal; and performing beamforming on the whitened echo cancelled signal, based on the echo path TF, the speech path RTF, and the estimated square root of the inverse of the covariance matrix of the additive noise.

Example 16 includes the subject matter of Example 15, wherein the estimation of the echo path TF comprises a Recursive Least Squares (RLS)-Inverse QR Decomposition (IQRD) operation.

Example 17 includes the subject matter of Examples 15 or 16, wherein the estimation of the square root of the inverse of the covariance matrix of the additive noise comprises an RLS-IQRD operation.

Example 18 includes the subject matter of any of Examples 15-17, wherein the beamforming is weighted Minimum Variance Distortionless Response (MVDR) beamforming, the computer readable storage medium further comprising the operation of generating the echo signal to include non-linear distortion components, the MVDR beamforming further to reduce the non-linear distortion components of the echo signal.

Example 19 includes the subject matter of any of Examples 15-18, wherein the estimating of the speech path RTF is performed during time periods associated with the presence of the speech signal and the absence of the echo signal.

Example 20 includes the subject matter of any of Examples 15-19, wherein the processor-based system is a smartphone and the echo signal is generated by a loudspeaker of the smartphone during a voice call in speakerphone mode.

Example 21 includes the subject matter of any of Examples 15-20, wherein the processor-based system is a smart-speaker system and the echo signal is generated by playing selected audio content.

Example 22 is a system for reducing noise and echo in an audio signal, the system comprising: means for estimating a transfer function (TF) of an echo path associated with a received audio signal, the audio signal including a combination of a speech signal, additive noise, and an echo signal, the estimation based on the reference signal; means for performing cancellation of one or more linear components of the echo signal, based on the echo path TF, to provide an echo cancelled signal means for estimating a square root of an inverse of a covariance matrix of the additive noise; means for whitening the echo cancelled signal; means for estimating a speech path RTF associated with the speech signal, based on the whitened echo cancelled signal; and means for performing beamforming on the whitened echo cancelled signal, based on the echo path TF, the speech path RTF, and the estimated square root of the inverse of the covariance matrix of the additive noise.

Example 23 includes the subject matter of Example 22, wherein the estimation of the echo path TF employs a Recursive Least Squares (RLS)-Inverse QR Decomposition (IQRD).

Example 24 includes the subject matter of Examples 22 or 23, wherein the estimation of the square root of the inverse of the covariance matrix of the additive noise employs an RLS-IQRD.

Example 25 includes the subject matter of any of Examples 22-24, wherein the beamforming is weighted Minimum Variance Distortionless Response (MVDR) beamforming, the system further comprising means for generating the echo signal to include non-linear distortion components, the MVDR beamforming further to reduce the non-linear distortion components of the echo signal.

Example 26 includes the subject matter of any of Examples 22-25, wherein the estimating of the speech path RTF is performed during time periods associated with the presence of the speech signal and the absence of the echo signal.

Example 27 includes the subject matter of any of Examples 22-26, wherein the processor-based system is a smartphone and the echo signal is generated by a loudspeaker of the smartphone during a voice call in speakerphone mode.

Example 28 includes the subject matter of any of Examples 22-27, wherein the processor-based system is a smart-speaker system and the echo signal is generated by playing selected audio content.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. It is intended that the scope of the present disclosure be limited not by this detailed description, but rather by the claims appended hereto. Future filed applications claiming priority to this application may claim the disclosed subject matter in a different manner, and may generally include any set of one or more elements as variously disclosed or otherwise demonstrated herein.

What is claimed is:

1. A processor-implemented method for reducing noise and echo in an audio signal, the method comprising:

estimating, by a processor-based system, a transfer function (TF) of an echo path associated with a received audio signal, the audio signal including a combination of a speech signal, additive noise, and an echo signal, the estimation based on a reference signal;

performing, by the processor-based system, cancellation of one or more linear components of the echo signal, based on the echo path TF, to provide an echo cancelled signal;

estimating, by the processor-based system, a square root of an inverse of a covariance matrix of the additive noise;

whitening, by the processor-based system, the echo cancelled signal;

estimating, by the processor-based system, a speech path relative transfer function (RTF) associated with the speech signal, based on the whitened echo cancelled signal; and performing, by the processor-based system, beamforming on the whitened echo cancelled signal, based on the echo path TF, the speech path RTF, and the estimated square root of the inverse of the covariance matrix of the additive noise.

2. The method of claim 1, wherein the estimation of the echo path TF employs a Recursive Least Squares (RLS)-Inverse QR Decomposition (IQRD).

3. The method of claim 1, wherein the estimation of the square root of the inverse of the covariance matrix of the additive noise employs an RLS-IQRD.

4. The method of claim 1, wherein the beamforming is weighted Minimum Variance Distortionless Response (MVDR) beamforming, the method further comprising generating the echo signal to include non-linear distortion components, the MVDR beamforming further to reduce the non-linear distortion components of the echo signal.

5. The method of claim 1, wherein the estimating of the speech path RTF is performed during time periods associated with the presence of the speech signal and the absence of the echo signal.

6. The method of claim 1, wherein the processor-based system is a smartphone and the echo signal is generated by a loudspeaker of the smartphone during a voice call in speakerphone mode.

7. The method of claim 1, wherein the processor-based system is a smart-speaker system and the echo signal is generated by playing selected audio content.

8. A system for reducing noise and echo in an audio signal, the system comprising:

an echo path transfer function (TF) estimation circuit to estimate the TF of an echo path associated with a received audio signal, the audio signal including a combination of a speech signal, additive noise, and an echo signal, the estimation based on a reference signal;

an echo canceller application circuit to cancel one or more linear components of the echo signal, based on the echo path TF, to provide an echo cancelled signal;

a matrix square root estimation circuit to estimate a square root of an inverse of a covariance matrix of the additive noise;

a whitening circuit to whiten the echo cancelled signal;

a speech path estimation circuit to estimate a speech path relative transfer function (RTF) associated with the speech signal, based on the whitened echo cancelled signal; and a spatial filtering circuit to perform beamforming on the whitened echo cancelled signal, based on the echo path TF, the speech path RTF, and the estimated square root of the inverse of the covariance matrix of the additive noise.

9. The system of claim 8, wherein the echo path TF estimation circuit is further to estimate the echo path TF based on a Recursive Least Squares (RLS)-Inverse QR Decomposition (IQRD).

10. The system of claim 8, wherein the matrix square root estimation circuit is further to estimate the square root of the inverse of the covariance matrix of the additive noise based on an RLS-IQRD.

11. The system of claim 8, wherein the beamforming is weighted Minimum Variance Distortionless Response (MVDR) beamforming, the system further comprising a loudspeaker to generate the echo signal to include non-linear distortion components, the spatial filtering circuit further to reduce the non-linear distortion components of the echo signal.

12. The system of claim 8, wherein the estimating of the speech path RTF is performed during time periods associated with the presence of the speech signal and the absence of the echo signal.

13. The system of claim 8, wherein the system is a smartphone and the echo signal is generated by a loudspeaker of the smartphone during a voice call in speakerphone mode.

14. The system of claim 8, wherein the system is a smart-speaker system and the echo signal is generated by playing selected audio content.

15. At least one non-transitory computer readable storage medium having instructions encoded thereon that, when executed by one or more processors, cause a process to be carried out for reducing noise and echo in an audio signal, the process comprising:

estimating a transfer function (TF) of an echo path associated with a received audio signal, the audio signal including a combination of a speech signal, additive noise, and an echo signal, the estimation based on a reference signal;

performing cancellation of one or more linear components of the echo signal, based on the echo path TF, to provide an echo cancelled signal;

estimating a square root of an inverse of a covariance matrix of the additive noise;

whitening the echo cancelled signal;

estimating a speech path relative transfer function (RTF) associated with the speech signal, based on the whitened echo cancelled signal; and performing beamforming on the whitened echo cancelled signal, based on the echo path TF, the speech path RTF, and the estimated square root of the inverse of the covariance matrix of the additive noise.

16. The computer readable storage medium of claim 15, wherein the estimation of the echo path TF comprises a Recursive Least Squares (RLS)-Inverse QR Decomposition (IQRD) operation.

17. The computer readable storage medium of claim 15, wherein the estimation of the square root of the inverse of the covariance matrix of the additive noise comprises an RLS-IQRD operation.

18. The computer readable storage medium of claim 15, wherein the beamforming is weighted Minimum Variance Distortionless Response (MVDR) beamforming, the computer readable storage medium further comprising the operation of generating the echo signal to include non-linear distortion components, the MVDR beamforming further to reduce the non-linear distortion components of the echo signal.

19. The computer readable storage medium of claim 15, wherein the estimating of the speech path RTF is performed during time periods associated with the presence of the speech signal and the absence of the echo signal.

20. The computer readable storage medium of claim 15, wherein the processor-based system is a smartphone and the echo signal is generated by a loudspeaker of the smartphone during a voice call in speakerphone mode.

21. The computer readable storage medium of claim 15, wherein the processor-based system is a smart-speaker system and the echo signal is generated by playing selected audio content.

* * * * *